US007874368B2

(12) United States Patent
Blaquiere

(10) Patent No.: US 7,874,368 B2
(45) Date of Patent: Jan. 25, 2011

(54) INSERTABLE PROGRESSIVE CAVITY PUMP SYSTEMS AND METHODS OF PUMPING A FLUID WITH SAME

(75) Inventor: Denis J. Blaquiere, Lloydminster (CA)

(73) Assignee: National Oilwell Varco, L.P., Houston, TX (US)

( * ) Notice: Subject to any disclaimer, the term of this patent is extended or adjusted under 35 U.S.C. 154(b) by 154 days.

(21) Appl. No.: 12/237,511

(22) Filed: Sep. 25, 2008

(65) Prior Publication Data

US 2009/0078426 A1 Mar. 26, 2009

Related U.S. Application Data

(60) Provisional application No. 60/975,460, filed on Sep. 26, 2007.

(51) Int. Cl.
*E21B 43/00* (2006.01)

(52) U.S. Cl. ..... 166/370; 166/68

(58) Field of Classification Search ..... 166/370, 166/105, 68, 250.08
See application file for complete search history.

(56) References Cited

U.S. PATENT DOCUMENTS 3,347,169 A * 10/1967 Cronin, Jr. et al. ..... 418/48
4,390,065 A 6/1983 Richardson
4,592,427 A 6/1986 Morgan
5,209,294 A * 5/1993 Weber ..... 166/105
5,327,975 A * 7/1994 Land ..... 166/369
5,549,160 A 8/1996 Bownes et al.
6,371,206 B1 * 4/2002 Mills ..... 166/311
6,729,391 B2 * 5/2004 Hill et al. ..... 166/68.5
7,201,222 B2 * 4/2007 Kanady et al. ..... 166/68
7,431,095 B2 * 10/2008 Olson et al. ..... 166/378
2002/0195254 A1 12/2002 Rowan et al.

OTHER PUBLICATIONS

International Search Report and Written Opinion dated Apr. 21, 2009 for Appl. No. PCT/US2008/077788; (14 p.).

* cited by examiner

*Primary Examiner*—Kenneth Thompson
*Assistant Examiner*—Catherine Loikith
(74) *Attorney, Agent, or Firm*—Conley Rose, P.C.

(57) ABSTRACT

A progressive cavity pump system. In an embodiment, the system comprises a tubing string disposed within a borehole. The tubing string including a seating nipple disposed at a predetermined depth in the tubing string. In addition, the system comprises a stator positioned within the tubing string. The stator includes a radially outer housing having an upper end and a lower end, a radially inner liner having a helical-shaped inner surface, a seating mandrel coupled to the upper end of the housing. Further, the system comprises a seal element disposed about the seating mandrel. The seal element forms a static seal with the inner surface of the seating nipple.

21 Claims, 13 Drawing Sheets

INSERTABLE PROGRESSIVE CAVITY PUMP SYSTEMS AND METHODS OF PUMPING A FLUID WITH SAME

CROSS-REFERENCE TO RELATED APPLICATIONS

This application claims benefit of U.S. provisional application Ser. No. 60/975,460 filed Sep. 26, 2007, and entitled "Insertable Progressive Cavity Pump," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to downhole tools. More particularly, the present invention relates to progressive cavity pumps. Still more particularly, the present invention relates to progressive cavity pumps that are insertable and moveable through a tubing string disposed within a well.

2. Background of the Invention

A progressive cavity pump (PC pump), also know as a "Moineau" pump, transfers fluid by means of a sequence of discrete cavities that move through the pump as a rotor is turned within a stator. Transfer of fluid in this manner results in a volumetric flow rate proportional to the rotational speed of the rotor within the stator, as well as relatively low levels of shearing applied to the fluid. Consequently, progressive cavity pumps are typically used in fluid metering and pumping of viscous or shear sensitive fluids, particularly in downhole operations for the ultimate recovery of oil and gas. A PC pump may be used in reverse as a positive displacement motor (PD motor) to convert the hydraulic energy of a high pressure fluid into mechanical energy in the form of speed and torque output, which may be harnessed for a variety of applications, including downhole drilling.

As shown in FIGS. 1 and 2, a conventional PC pump 10 comprises a helical-shaped rotor 30, typically made of steel that may be chrome-plated or coated for wear and corrosion resistance, disposed within a stator 20, typically a heat-treated steel tube or housing 25 lined with a helical-shaped elastomeric insert 21. The helical-shaped rotor 30 defines a set of rotor lobes 37 that intermesh with a set of stator lobes 27 defined by the helical-shaped insert 21. As best shown in FIG. 2, the rotor 30 typically has one fewer lobe 37 than the stator 20. When the rotor 30 and the stator 20 are assembled, a series of cavities 40 are formed between the outer surface 33 of the rotor 30 and the inner surface 23 of the stator 20. Each cavity 40 is sealed from adjacent cavities 40 by seals formed along the contact lines between the rotor 30 and the stator 20. The central axis 38 of the rotor 30 is parallel to and radially offset from the central axis 28 of the stator 20 by a fixed value known as the "eccentricity" of the PC pump.

During operation of the PC pump 10, the application of torque to rotor 30 causes rotor 30 to rotate within stator 20, resulting in fluid flow through the length of PC pump 10. In particular, adjacent cavities 40 are opened and filled with fluid as rotor 30 rotates relative to stator 20. As this rotation and filling process repeats in a continuous manner, fluid flows progressively down the length of PC pump 10.

PC pumps are used extensively in the oil and gas industry for operating low pressure oil wells and also for raising water from a well. As shown in FIG. 3, PC pump 10 previously described disposed in a cased borehole 50 in a conventional manner to pump oil to the surface. Since PC pumps (e.g., PC pump 10) are often mounted tens or hundreds of meters below the surface, it is difficult to mount an electric drive motor to the PC pump. Consequently, as shown in FIG. 3, it has become common practice to secure the stator 20 on to the lower end of a string of production tubing 60. In particular, the upper threaded end of the stator housing 25 is axially connected end-to-end with the lower threaded end of the production tubing 60 with a mating threaded collar 65. Once the stator 20 is secured to the lower end of the production tubing 60, it is lowered into the cased borehole 50 on the tubing string 60. Thus, the production tubing 60 is used both to position stator 20 and PC pump 10 at a specific depth in the well bore, and to axially support the weight of the PC pump 10 and the weight of the fluid column extending between the PC pump 10 and the surface which bears against the upper end of stator liner 21.

Once the stator 20 is properly positioned at the desired depth for production, the upper end of the rotor 30 is threaded to the lower end of a sucker rod string 70 at the surface, lowered through the production tubing 60, and inserted into the stator liner 21. The rotor 30 is lower until the lower end of rotor 30 hits a tag-bar 80 extending across the lower portion of the stator 20. Once the lower end of the rotor 30 contacts tag-bar 80, the entire rod string 70 is lifted upward a predetermined distance to position the entire rotor 30 within the stator 20. To begin pumping, a drivehead at the surface applies rotational torque to the rod string 70, which in turn causes downhole rotor 30 to rotate relative to the stator 20.

One disadvantage of such conventional PC pumps and delivery methods is that the entire production tubing string 60 must be pulled from the cased borehole 50 to access, service, and/or repair the stator 20. Following service and/or repair, the stator 20 is reattached to the lower end of the production tubing 60 and lowered into the cased borehole 50, followed by the delivery of rotor 30 to stator 20 on rod sting 70. This process is time consuming, costly, and results in undesirable production delays.

FIG. 4 shows a conventional insertable PC pump 100 being disposed in the cased borehole 50. Insertable PC pump 100 is configured such that the entire PC pump 100, including the rotor 130 and the stator 120, is lowered into the production tubing 60 as a single package. As compared to the conventional PC pump 10 shown in FIG. 3, the stator housing 125 of insertable PC pump 100 is longer. In particular, housing 125 is sufficiently long to accommodate liner 121 in its lower portion, and accommodate rotor 130, axially spaced from liner 121, in its upper portion. A "no-go" assembly 190 is provided on the lower end of rod string 70 to prevent rotor 130 from being completely pulled from the stator housing 125. To lower PC pump 100 into the production tubing 60, the upper end of rotor 130 is secured to the lower end of the rod string 70, and stator housing 125 is hung from rod string 70 via no-go assembly 190. Then the entire PC pump 100 is lowered into the production tubing 60, the No-Go assembly 190 and rod string 70 supporting the entire weight of the PC pump 100.

Housing 125 is sufficiently long to permit rotor 130 to be axially pulled from liner 121, while still remaining within housing 125. This configuration allows rotor 130 to be pulled from of the stator liner 121 to flush the PC pump 100 without pulling the entire PC pump 100 out of the well. In some cases, housing 125 may be lengthened fifty feet or more to provide sufficient space to accommodate rotor 130 when it is axially spaced above stator 120. The additional length of housing 125 undesirably increases the weight and bulk of PC pump 100.

PC pump 100 is lowered to the desired depth at which an annular seating nipple, previously installed in the tubing string 60, is engaged by stator 120, thereby resisting the continued lowering of PC pump 100. In many conventional PC pumps, a locking or retaining mechanism (not shown) is provided between the stator and the seating nipple to lock and hold down the PC pump within the tubing string. However, such hold-down assemblies often require complex actuation, may become jammed or damaged, and add another degree of complexity to the PC pump assembly and installation.

Once stator 120 is properly seated and retained, continued lowering of stator 120 is prevented. However, rotor 130 may still be lowered within housing 130 until it is sufficiently positioned within the stator liner 121, at which time rod string 70 may be rotated to power PC pump 100. Any gaps or flow passages between stator 120 and the seating nipple reduce the effectiveness of PC pump 100 as they relieve the pressure differential between the ends of PC pump 100.

Accordingly, there remains a need in the art for improved insertable PC pumps and methods of delivering the same. Such devices, methods, and systems would be particularly well received if capable of being inserted into and moveable within into a tubing string, capable of being pressure tested to ensure a sufficient seal between the stator and the production tubing within which it is disposed, and capable of being handled and manipulated with relative ease.

BRIEF SUMMARY OF SOME OF THE PREFERRED EMBODIMENTS

These and other needs in the art are addressed in one embodiment by a progressive cavity pump system. In an embodiment, the system comprises a tubing string disposed within a borehole. The tubing string including a seating nipple disposed at a predetermined depth in the tubing string. In addition, the system comprises a stator positioned within the tubing string. The stator includes a radially outer housing having an upper end and a lower end, a radially inner liner having a helical-shaped inner surface, a seating mandrel coupled to the upper end of the housing. Further, the system comprises a seal element disposed about the seating mandrel. The seal element forms a static seal with the inner surface of the seating nipple.

Theses and other needs in the art are addressed in another embodiment by a method of pumping fluid from a well to the surface. In an embodiment, the method comprises coupling a delivery/retrieval tool to the lower end of a rod string. In addition, the method comprises coupling an upper end of a stator to a lower end of the delivery/retrieval tool. Further, the method comprises lowering the stator into a tubing string disposed in a borehole. Still further, the method comprises positioning the stator at a predetermined depth in the tubing string. Moreover, the method comprises pressure testing the tubing string with the delivery/retrieval tool.

Theses and other needs in the art are addressed in another embodiment by a method of pumping fluid from a well to the surface. In an embodiment, the method comprises coupling a stator to a rod string. In addition, the method comprises inserting the stator into a tubing string disposed in a borehole. Further, the method comprises delivering the stator to a predetermined depth within the tubing string with the rod string. Still further, the method comprises decoupling the stator and the rod string downhole. Moreover, the method comprises coupling a rotor to the rod string. In addition, the method comprises delivering the rotor to the stator on the rod string. Further, the method comprises inserting the rotor into the stator. Still further, the method comprises rotating the rotor relative to the stator.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the embodiments, reference will now be made to the following accompanying drawings.

DETAILED DESCRIPTION OF SOME OF THE PREFERRED EMBODIMENTS

Figure 1:
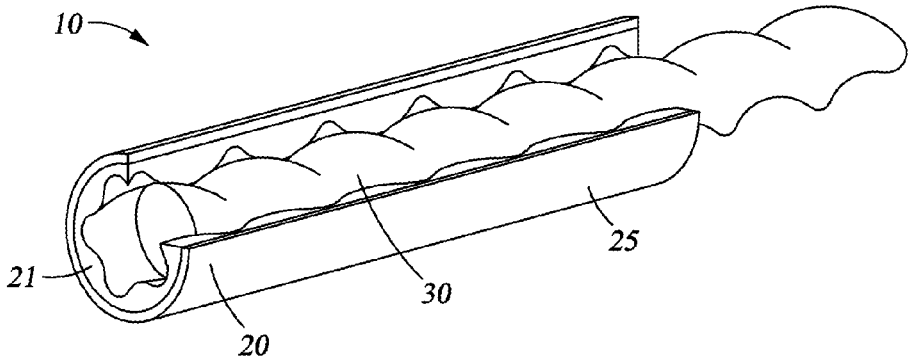
Fig. 1 (PRIOR ART)
FIG. 1 is a perspective, partial cut-away view of a conventional progressive cavity pump.
Figure 2:
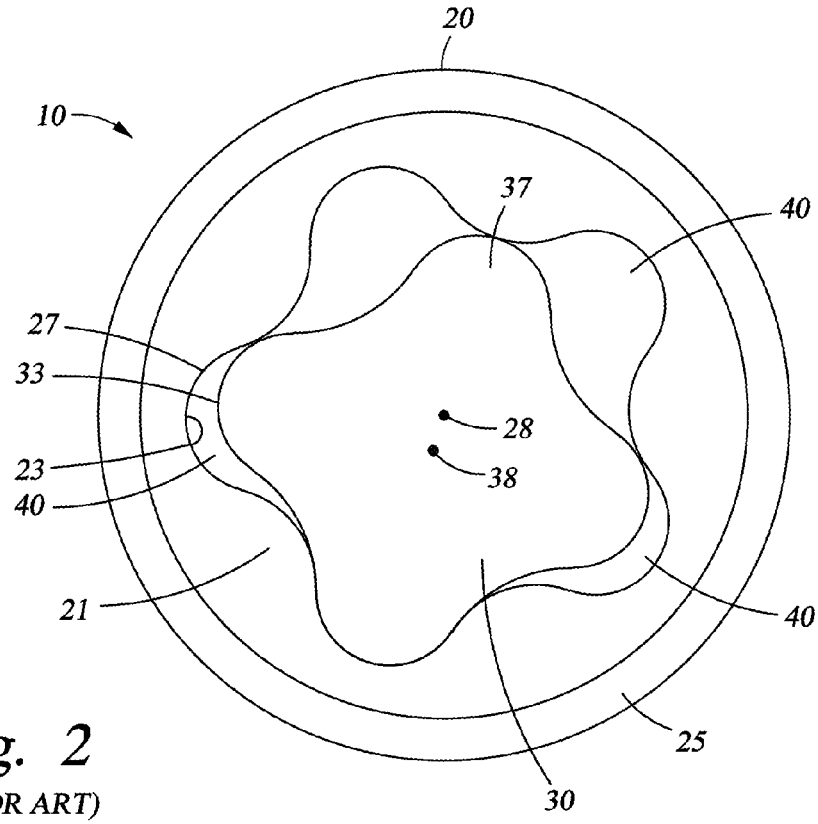
Fig. 2 (PRIOR ART)
FIG. 2 is a cross-sectional end view of the progressive cavity pump of FIG. 1.
Figure 3:
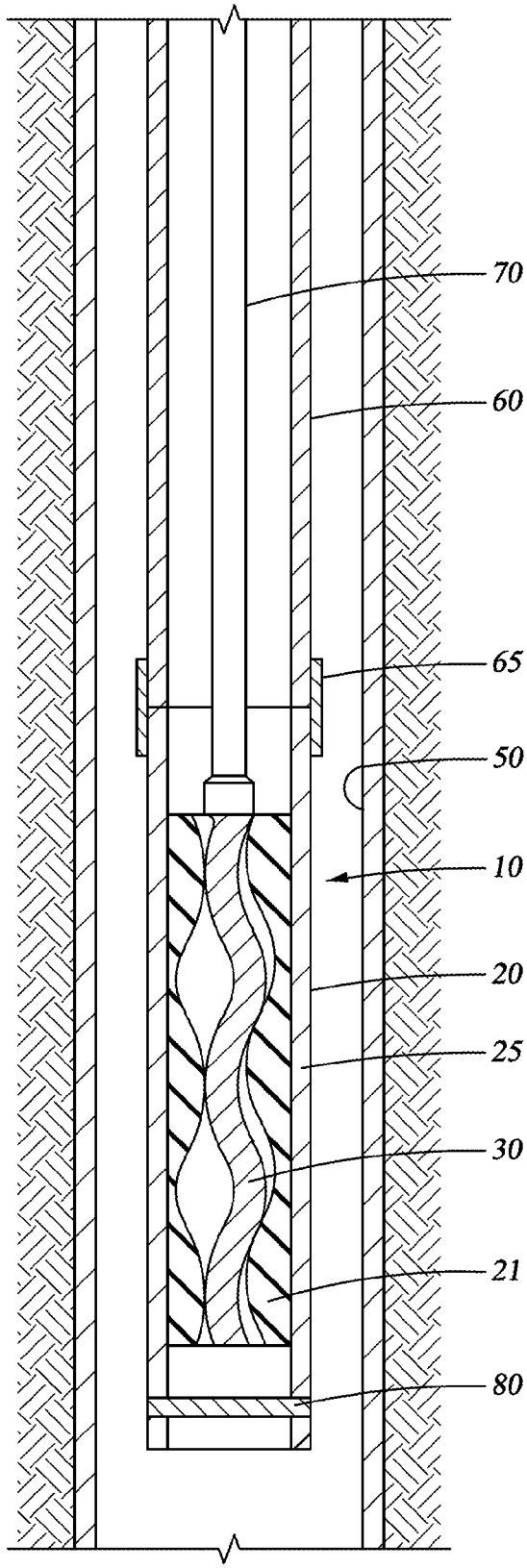
Fig. 3 (PRIOR ART)
FIG. 3 is a cross-sectional view of the progressive cavity pump of FIG. 1 conventionally delivered downhole on the lower end of tubing string.
Figure 4:
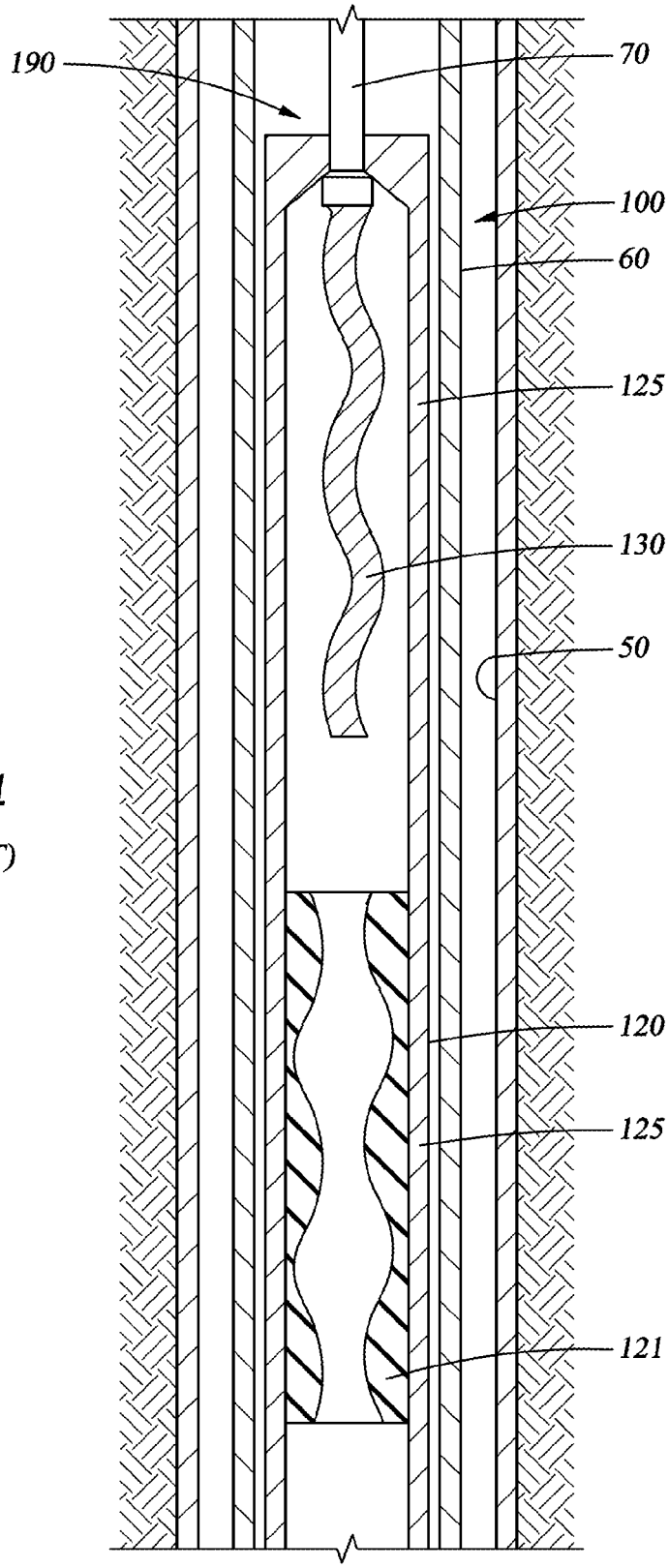
Fig. 4 (PRIOR ART)
FIG. 4 is a cross-sectional view of a conventional insertable progressive cavity pump delivered downhole on a rod string.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names.

This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices and connections.

Figure 5:
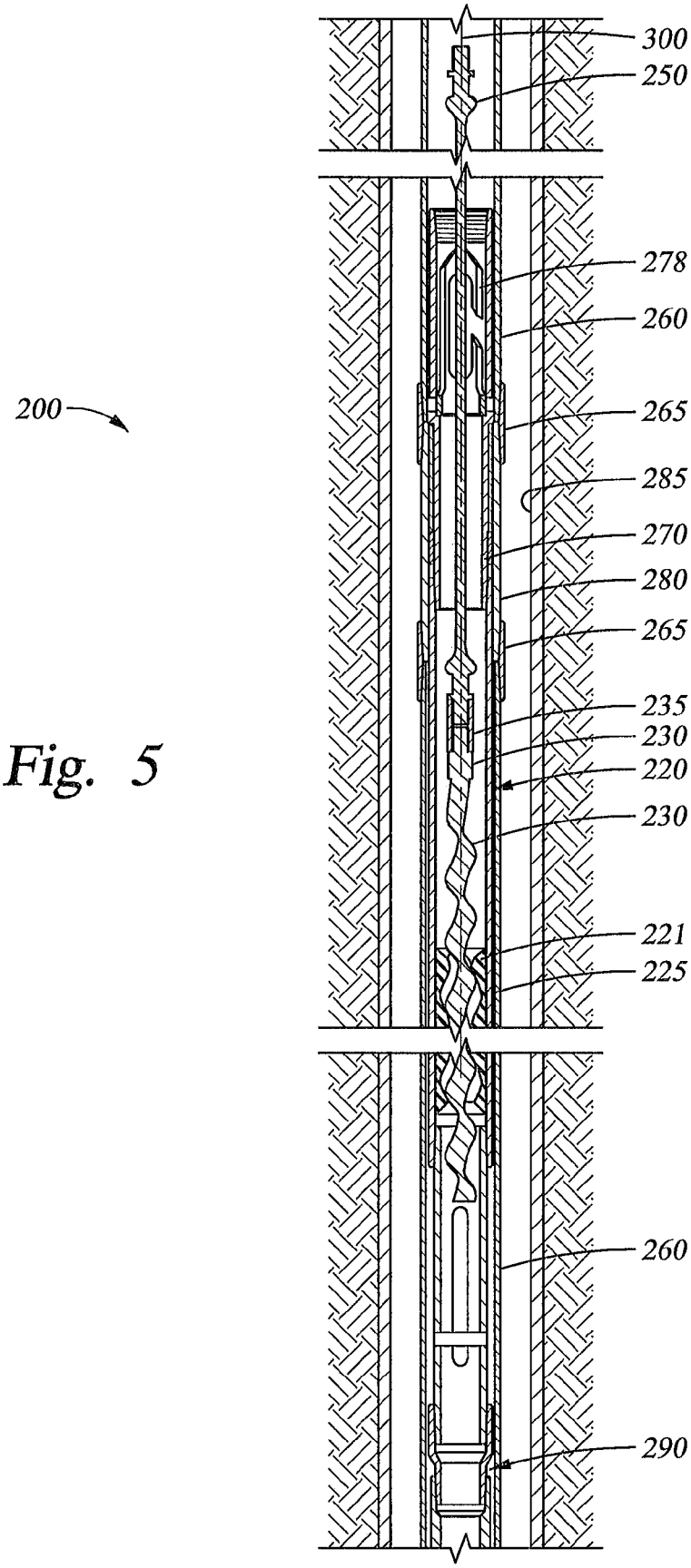
FIG. 5 is a cross-sectional view of an embodiment of an insertable progressive cavity pump system in accordance with the principles described herein.
Figure 6:
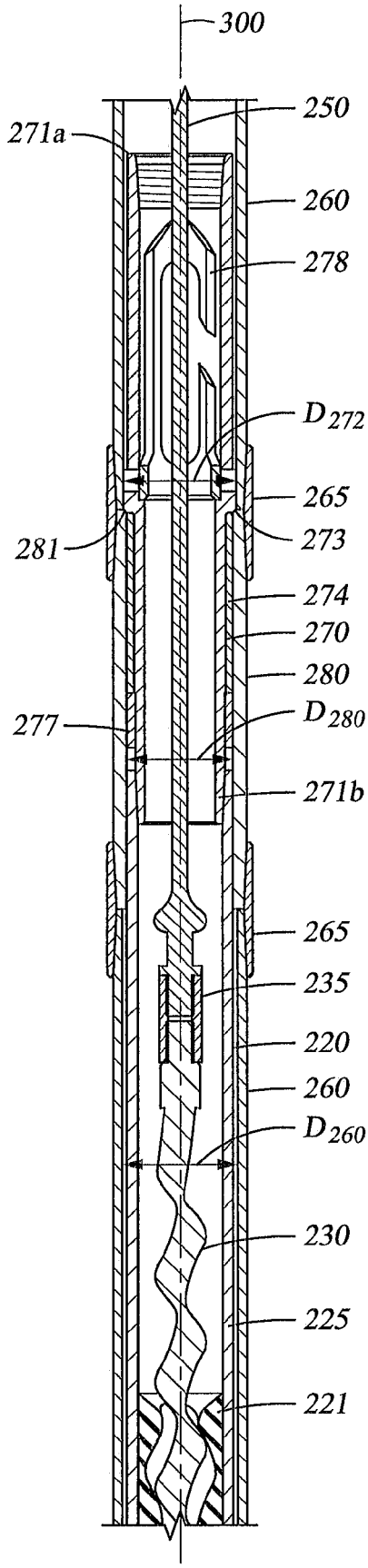
FIG. 6 is an enlarged cross-sectional view of the insertable progressive cavity pump system of FIG. 5.

Referring now to FIGS. 5 and 6, an embodiment of an insertable progressive cavity pump system 200 for pumping a fluid (e.g., pumping oil in a well to the surface) is shown. PC pump system 200 comprises a stator 220, a rotor 230 disposed in stator 220, and a torque resisting device 290 coupled to the lower end of stator 220 and adapted to resist the rotation of stator 220 relative to production tubing string 260. As shown in FIGS. 5 and 6, PC pump system 200 is positioned "downhole" in a production tubing string 260 disposed in a cased wellbore 285. Stator 220, rotor 230, tubing string 260, and cased wellbore 285 are coaxially arranged, each sharing a common central axis 300. As used herein, the terms "axial" and "axially" refer to positions and movement measured parallel to a central axis (e.g., axis 300), while the terms "radial" and "radially" refer to positions and movement measured perpendicular to a central axis.

Stator 220 comprises a generally cylindrical radially outer housing 225, a stator liner 221 having a helical-shaped inner surface adapted to mate with the helical-shaped outer surface of rotor 230, and a seating mandrel 270. Stator liner 221 is disposed in housing 225 proximal the lower end of stator 220. Seating mandrel 270 is coaxially coupled to the upper end of stator housing 225 with mating threads, thereby forming the upper end of stator 220.

Figure 7:
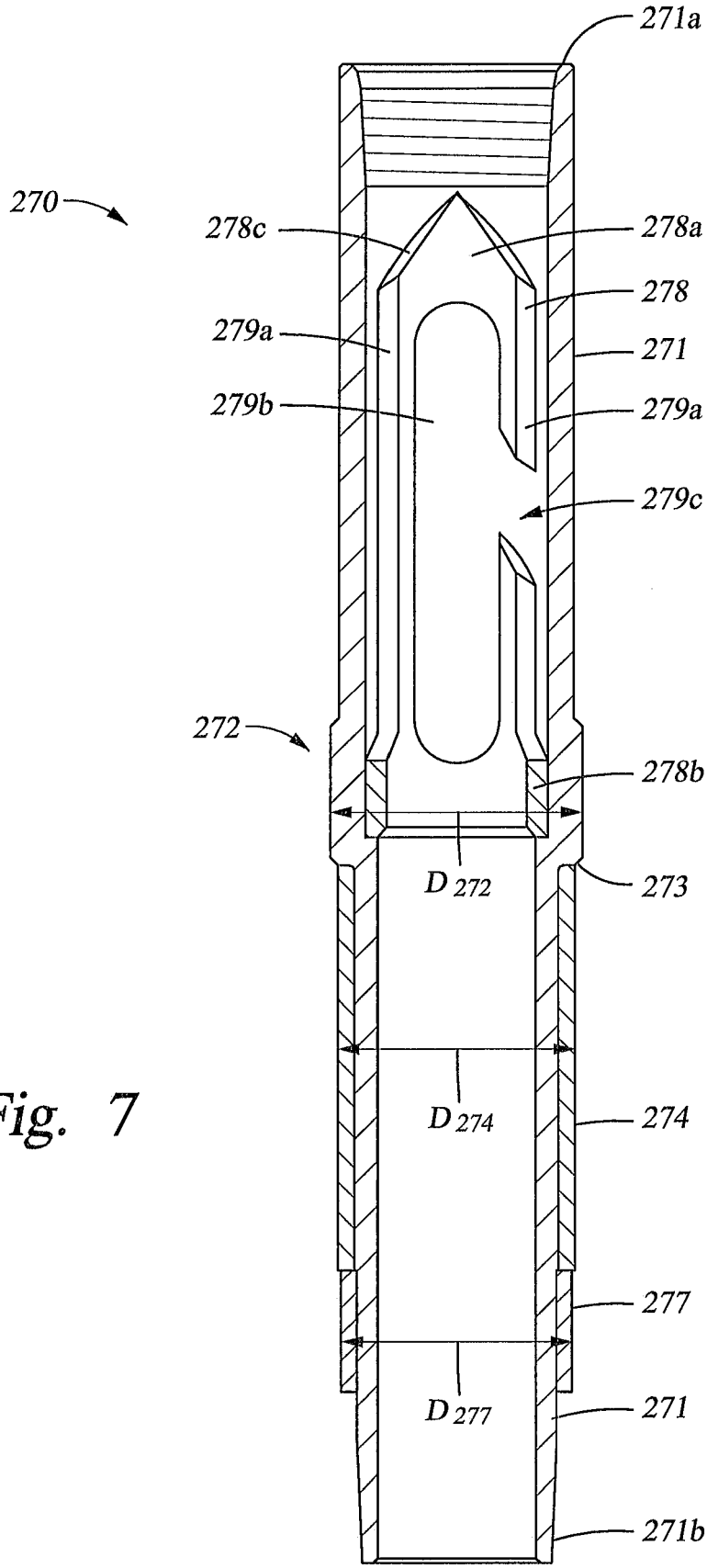
FIG. 7 is a cross-sectional view of the seating mandrel of FIG. 5.

Referring briefly to FIG. 7, seating mandrel 270 comprises a generally cylindrical body 271 having an upper end 271*a* and a lower end 271*b*, a coupling member 278 disposed within upper end 271*a* of body 271, an annular seal element 274 disposed about body 271 between ends 271*a*, 271*b*, and a seal retainer ring 277 disposed about lower end 271*b* of body 271 axially adjacent and below seal element 274.

The outer surface of body 271 includes an annular, radially expanded section 272 having an increased diameter and defining an annular shoulder 273. Seal element 274 is axially positioned between shoulder 273 and retainer ring 277. Seal retainer ring 277 aids in maintaining the position of seal element 274. In particular, seal element 274 is disposed about lower end 271*b* of body 271 and slid axially upward until it abuts shoulder 273. Then seal retainer ring 274 is disposed about lower end 271*b* and is advanced axially upwards until it abuts seal element 274. In this embodiment, seal retainer ring 277 is coupled to body 271 and axially advanced relative to body 271 via mating threads. One or more O-ring seals may be positioned radially between seal element 274 and body 271 to seal therebetween and to minimize relative movement therebetween. In general, seal element 274 may have any suitable configuration, including without limitation, a cylindrical sleeve, a tapered sleeve, a ring, etc. Further, seal element 274 may comprise any suitable material including, without limitation, a metal or metal alloy (e.g., steel, aluminum, etc.), a non-metal (e.g., Kevlar® or Teflon® available from E.I. du Pont de Nemours and Company of Wilmington, Del., USA, polymer, etc.), a composite (e.g., carbon fiber-epoxy composite, etc.), or combinations thereof. In this embodiment, seal element 274 is a cylindrical sleeve comprising Teflon®.

Referring still to FIG. 7, radially expanded section 272, and thus shoulder 273, has an outer diameter $D_{272}$ and seal element has an outer diameter $D_{274}$. In this embodiment, the outer surface of seal element 274 is cylindrical such that outer diameter $D_{274}$ is uniform along the axial length of seal element 274. Outer diameter $D_{272}$ is greater than outer diameter $D_{274}$ of seal element 274. Further, outer diameter $D_{274}$ of seal element 274 is greater than the outer diameter $D_{277}$ of seal retainer ring 277. Thus, shoulder 273 extends radially outward beyond seal element 274, and seal element 274 extends radially outward beyond seal retainer ring 277.

Coupling member 278 has an upper end 278*a* and a lower end 278*b* that is threadingly coupled to the inside of body 271. In this embodiment, coupling member 278 comprises a conventional J-latch member. In general, the J-latch member 278 may have any suitable configuration and geometry suitable for releasably coupling seating mandrel 270 and stator 220 to a tool or device for delivering and retrieving stator 220 downhole. In this embodiment, J-latch member 278 includes a pair of axially oriented access slots 279*a* extending from upper end 278*a*, a pair of axially oriented engagement slots 279*b* circumferentially spaced from access slots 279*a* (one engagement slot 279*b* shown in FIG. 7), and a pair of circumferentially oriented transfer slots 279*c* extending between parallel slots 279*a*, 279*b*. It should appreciated that engagement slots 279*b* do not extend through upper end 278*a*. Thus, engagement slot 279*b* may be accessed via axial movement from upper end 278*a* through slots 279*a* to transfer slot 279*c*, and then circumferential movement through slot 279*c* to engagement slot 279*b*. Upper end 278*a* of coupling member 278 comprises wedged or tapered surfaces 278*c*. As will be described in more detail below, coupling member 278 releasably couples seating mandrel 270 and stator 220 to a delivery/retrieval tool.

Referring again to FIGS. 5 and 6, seating mandrel 270 releasably and sealingly couples stator 220 to tubing string 260. In particular, tubing string 260 includes a seating nipple 280 couple to upper and lower sections of tubing string 260 with collars 265. Seating nipple 280 is preferably disposed at a predetermined depth in cased wellbore 285 suitable for production. Seating nipple 280 has an inner diameter $D_{280}$ that is less than the inner diameter $D_{260}$ of the remainder of tubing string 260, and thus, seating nipple 280 defines an annular shoulder 281 that extends radially inward from the inner cylindrical surface of tubing string 260. Outer diameter $D_{272}$ of shoulder 273 of seating mandrel 270 is greater than inner diameter $D_{280}$ of seating nipple 280, but less than inner diameter $D_{260}$ of the remainder of tubing string 260. Thus, when stator 220 is axially lowered into tubing string 260, seating mandrel 270 is free to advance through tubing string 260 until shoulders 273, 281 engage, thereby restricting seating mandrel 270 and stator 220 from continued axial advancement down tubing string 260.

As seating mandrel 270 is seated in seating nipple 280, seal element 274 forms a static seal with the inner surface of seating nipple 280, thereby restricting and/or preventing the axial flow of fluids between seal element 274 and seating nipple 280. In this embodiment, the static seal formed between seal element 274 and seating nipple 280 results from an interference fit. Outer diameter $D_{274}$ of seal member 274 is substantially the same or slightly greater than the inner diameter $D_{280}$ of seating nipple 280, and thus, seal element 274 is compressed between mandrel body 271 and seating nipple 280. The inner surface of seating nipple 280 is preferably micro honed for a relatively smooth sealing surface. As will be described in more detail below, the static seal formed between seal element 274 and seating nipple 280 may tested with a pressure testing tool.

In this embodiment, stator 220 is restricted from moving axially downward by shoulder 271, and is restricted from moving axially upward by its own weight, the weight of any fluid column within tubing string 260 above stator 220, and frictional engagement of seal element 274 and seating nipple 280. Therefore, in this embodiment, no additional retaining or locking mechanism is provided between stator 220 and tubing string 260 to restrict axial movement of stator 220 once properly positioned.

Referring still to FIGS. 5 and 6, rotor 230 is releasably coupled to the lower end of a rod string 250 and is delivered downhole to stator 220 via rod string 250. Specifically, rotor 230 is axially advanced through tubing string 260 and inserted into stator 220 until it is sufficiently positioned in stator liner 221. A tag-bar and associated space out procedures known in the art may be employed to ensure proper axial positioning of rotor 230 relative to stator 220 for efficient fluid pumping. In this embodiment, rotor 230 is coupled to rod string 250 with a coupling member 235 comprising a collar having internal threads proximal its upper end that threadingly engage mating external threads provided on the lower end of rod string 250, and having internal threads proximal its lower end that threadingly engage mating external threads provided on the upper end of rotor 230. Rod string 250 is rotated at the surface with a drivehead. The rotation of rod string 250 is translated to rotor 230, thereby enabling PC pump system 200 to pump fluids to the surface.

As rotor 230 is rotated within stator 220, periodic sealing engagement between rotor 230 and stator liner 221 will result in frictional forces that encourage stator 220 to rotate along with rotor 230. However, since the volumetric pumping rate of PC pump system 200 depends, at least in part, on the rotational speed of rotor 230 relative to stator 220, it is preferred that stator 220 be restricted from rotating relative to tubing string 260. Consequently, in this embodiment, torque resisting device 290, often call a no-turn device or torque anchor, is coupled to the lower end of stator 220 and engages tubing string 260 to restrict and/or prevent the rotation of stator 220 relative to tubing string 260. Any suitable torque resisting device or no-turn device 290 may be employed, including a variety of conventional known turn devices that releasably couple stator 220 to tubing string 260 and restrict rotational movement therebetween. In select embodiments, torque anchor 290 comprises a single jaw centered torque anchor. Torque anchor 290 is preferably sized such that it may be axially advanced through seating nipple 280 during installation of PC pump system 200 in tubing string 260.

Figure 8:
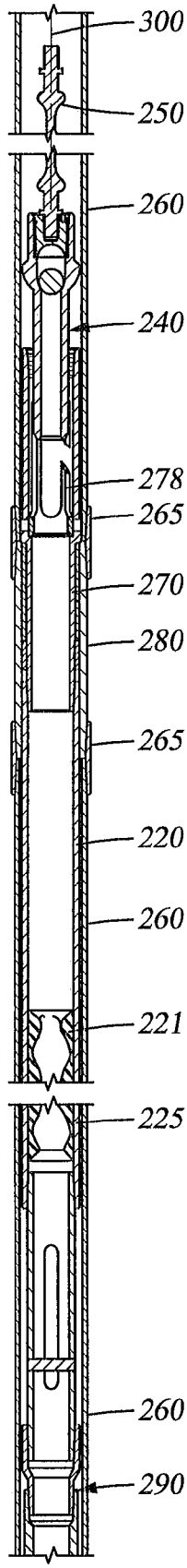
FIG. 8 is a cross-sectional view of the stator of FIG. 5 axially positioning an embodiment of delivery/retrieval tool.
Figure 9:
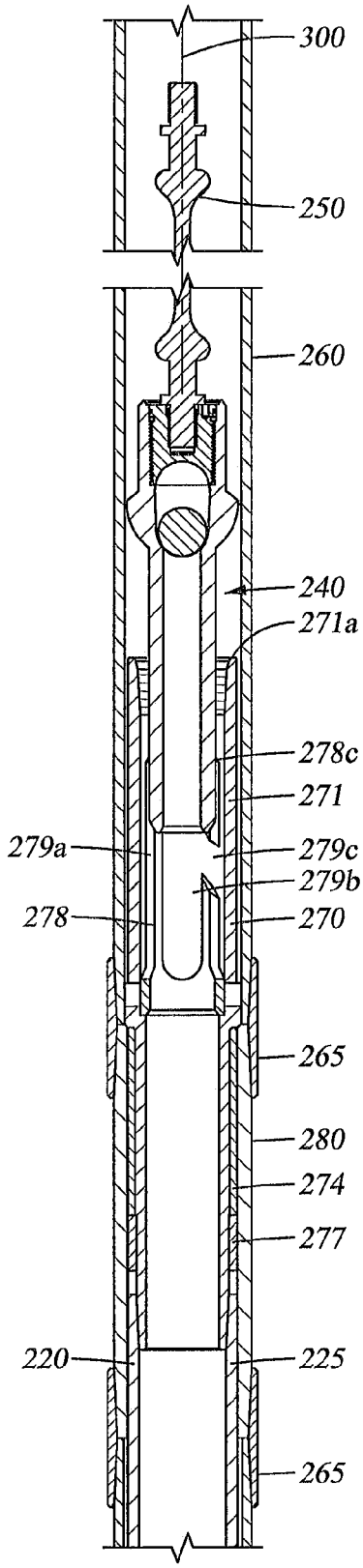
FIG. 9 is an enlarged cross-sectional view of the stator and the delivery/retrieval tool of FIG. 8.
Figure 10:
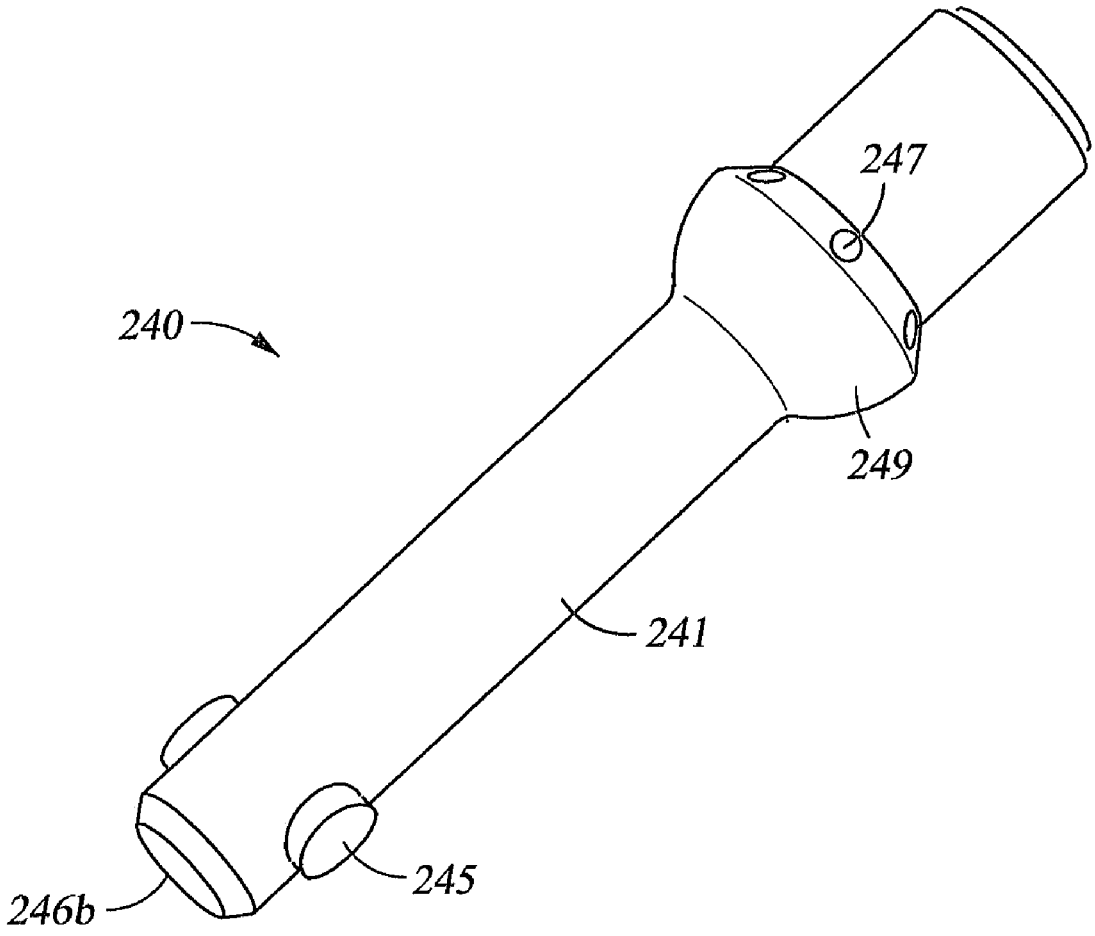
FIG. 10 is a perspective view of the delivery/retrieval tool of FIG. 8.

Referring now to FIGS. 8-10, stator 220 is shown being positioned within tubing string 260 with a delivery/retrieval tool 240. Delivery/retrieval tool 240 is releasably coupled to the lower end of rod string 250 with mating threads, and is lowered into tubing string 260 via rod string 250. As shown in FIGS. 8 and 9, tool 240 is coupled to stator 220 by coupling or J-latch member 278. In particular, tool 240 includes a coupling pin 245 (FIG. 10) that extends radially outward from the lower end of tool 240 and is adapted to releasably coupled tool 240 to J-latch member 278 of seating mandrel 270. The lower end of tool 240 is axially inserted and advanced into the upper end 271*a* of mandrel body 271 to J-latch member 278. As tool 240 is advanced into J-latch member 278, wedged surfaces 278*c* guide one or more pins 245 into one of access slots 279*a*. Tool 240 is axially advanced downward with pin 245 disposed in access slot 279 until pin 245 is axially aligned with transfer slot 279*c*, and then, tool 240 is rotated, thereby moving pin 245 circumferentially through transfer slot 279*c* and into engagement slot 279*b*. Once in slot 279*b*, pin 245 is free to move axially up or down within slot 279*b* without disengaging J-latch member 278 and stator 220. In this manner, stator 220 is releasably hung from tool 240, lowered into tubing string 260 with tool 240, and retrieved from tubing string 260 with tool 240. It should be appreciated that delivery and retrieval of stator 220 may be accomplished with tool 240 as opposed to a conventional no-go assembly. Although coupling member 278 is a J-latch member in this embodiment, in general, coupling member 278 may comprise any suitable means or mechanism for releasably coupling stator 220 to rod string 250 for delivery of stator 220 downhole.

For pumping operations, stator 220 is lowered and properly positioned in tubing string 260 with tool 240. The weight of stator 220 helps pull seal element 274 into the sealing engagement with seating nipple 280. However, to ensure sufficient sealing engagement between seal element 274 and seating nipple 280, a moderate downward force may be applied to stator 220 with rod string 250 and tool 240 via axial engagement of slot 279*b* and pin 245, thereby urging shoulders 281, 273 into positive engagement. Following sufficient positioning and seating of stator 220, tool 240 is decoupled from J-latch member 278 and stator 220 by lifting tool 240 a predetermined axial distance with rod string 250 to axially align coupling pin 245 with transfer slot 279*c*. Then, rod string 250 and tool 240 are rotated to move pin 245 circumferentially through transfer slot 279*c* into access slot 279*a*. Once within access slot 279*a*, tool 240 and pin 245 may be axially pulled from seating mandrel 270 with rod string 250 and removed to the surface.

Figure 11:
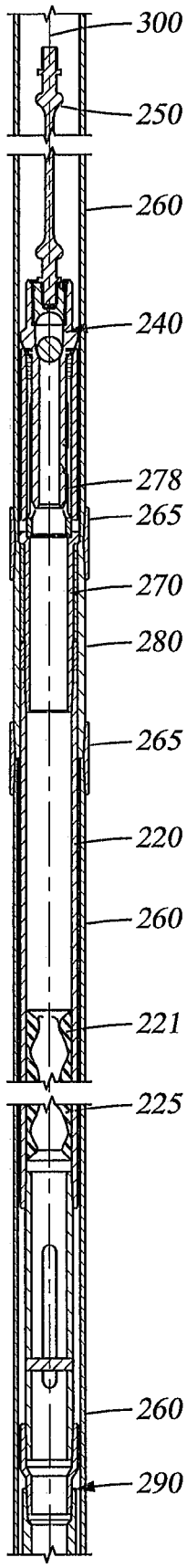
FIG. 11 is a cross-sectional view of the delivery/retrieval tool of FIG. 8 positioned to pressure test the tubing string and seal between the tubing string and the stator of FIGS. 5 and 8.
Figure 12:
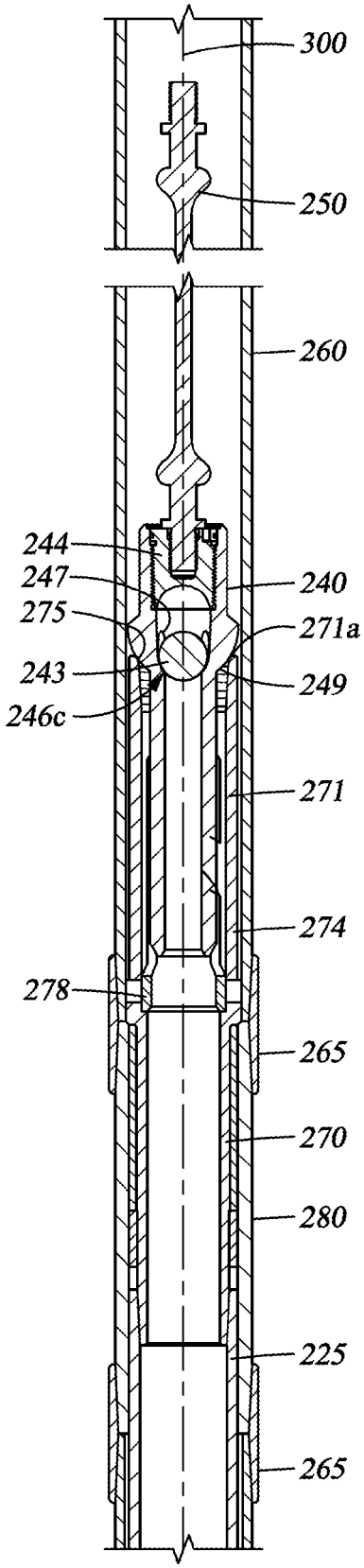
FIG. 12 is an enlarged cross-sectional view of the delivery/retrieval tool pressure testing the stator of FIG. 11.
Figure 13:
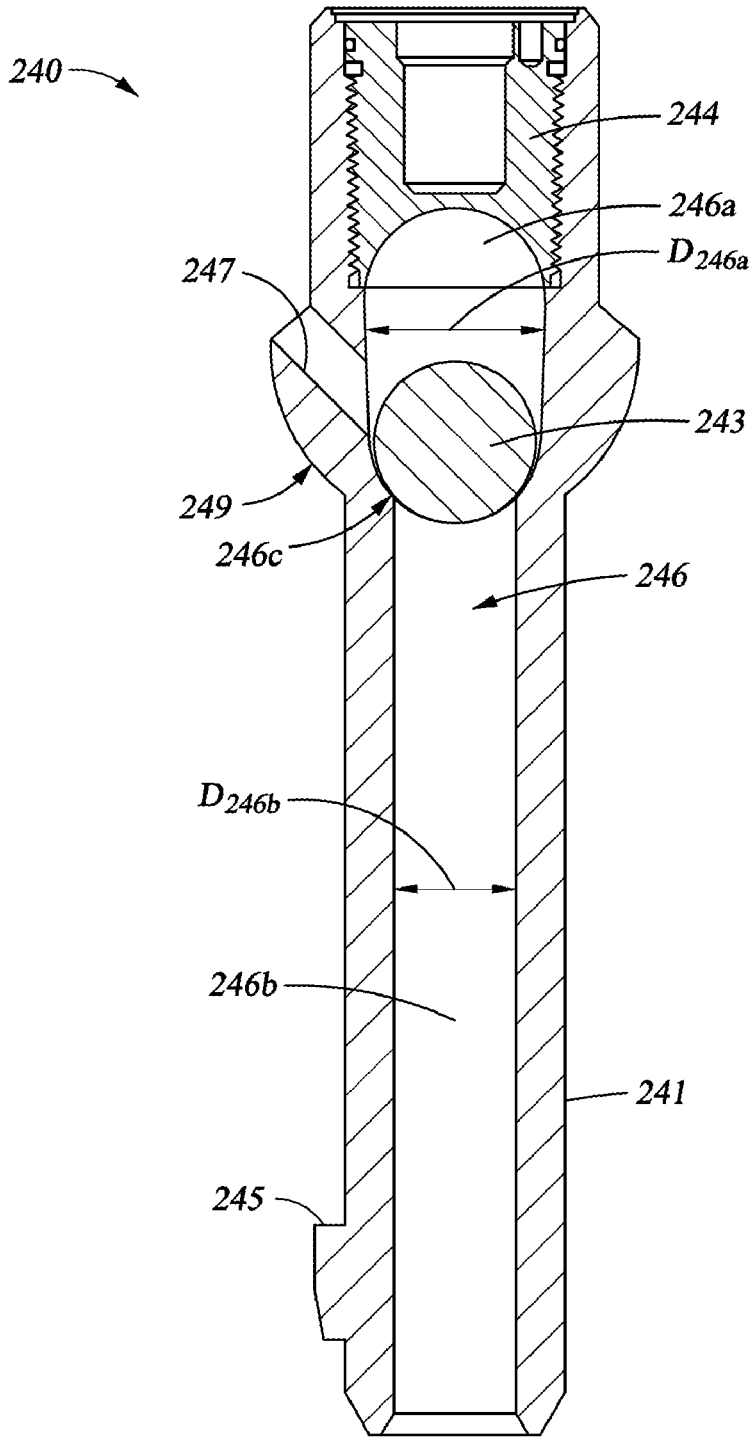
FIG. 13 is a cross-sectional view of the delivery/retrieval tool of FIG. 11.

Referring now to FIGS. 11-13, in this embodiment, delivery/retrieval tool 240 also functions as a pressure testing tool, and hence, may also be referred to herein as pressure testing tool 240. The ability to pressure test with tool 240 enables pressure testing of tubing string 260 for holes and/or wear cracks. Holes and/or cracks may arise for a variety of reasons including, without limitation, wear and tear, contact between the tubing string 260 and the rotating rod string 250 disposed within tubing 260, contact between the tubing string 260 and stator 220 as it was slidingly disposed within tubing string 260, or combinations thereof. The ability to pressure test with tool 240 also enables testing of the static seal formed between seal element 274 and seating nipple 280. In particular, it is preferred that the static seal maintain the pressure differential between the upper and lower ends of stator 220. As shown in FIGS. 11 and 12, tool 240 is positioned for pressure testing of tubing string 260 and the static seal between seal element 274 and seating nipple 280. Thus, tool 240 may be used to deliver/retrieve stator 220 from tubing string 260, and pressure test tubing string 260 and the seal formed between seal element 274 and seating nipple 280.

Referring specifically to FIGS. 12 and 13, tool 240 comprises a generally cylindrical housing 241 including an inner cavity 246 with a first or upper section 246*a* and a second or lower section 246*b*. Upper section axially extends from a lift seal adapter 244 disposed in the upper end of cavity 246 to lower section 246*b*, and lower section 246*b* axially extends from upper section 246*a* through the lower end of tool 240. Upper section 246*a* has a diameter $D_{246a}$ and lower section 246*b* has a diameter $D_{246b}$ that is less than diameter $D_{246a}$. Consequently, an annular seat 246*c* is formed at the intersection of sections 246*a*, 246*b*.

Lift seal adapted 244 is releasably coupled to the upper end of housing 241, allows for insertion of a plug or seal ball 243 into upper section 246*a* of cavity 246, and enables the coupling of rod string 250 to tool 240. Plug 243 is adapted to sealingly engage annular seat 246*c*. In addition, a plurality of circumferentially spaced bypass ports 247 each extend through housing 241 from upper section 246*a* of cavity 246 to the outer surface of housing 241. Tool 240 further includes a semi-spherical outer surface 249 proximal its upper end adapted to sealingly engages a mating frustoconical surface 275 on the upper end 271*a* of mandrel housing 271 to form an annular seal therebetween.

As stator 220 is lowered into tubing string 260 and towards seating nipple 280, the entire PC pump system 200 may become submerged in the reservoir fluid in tubing string 260. The height of the reservoir fluid in tubing string 260 will depend, at least in part, on the reservoir pressure. Due to the relatively tight radial clearance between seating mandrel 270 and tubing string 260, the reservoir fluids may be restricted from passing axially therebetween as they are volumetrically displaced by stator 220. Consequently, the reservoir fluids in tubing string 260 may provide fluid resistance to continued axial advancement of stator 220 into tubing string 260. However, cavity 246 and bypass ports 247 provide a bypass path for the reservoir fluids. In other words, cavity 246 and bypass ports 247 provide an alternate path for reservoir fluids that are restricted from flowing axially between tubing string 260 and seating mandrel 270. In particular, the reservoir fluids are free to flow through axially upward through liner 221 and stator housing 225, through lower section 246*b* of cavity 246 and into upper section 246 by pushing ball 243 axially upward and out of engagement with annular seat 246*c*, and through bypass ports 247 as stator 220 is lowered into tubing string 260. In this manner, fluid resistance provided by the reservoir fluids is relieved by allowing the reservoir fluids to flow freely across stator 220 as it is delivered downhole.

When seating mandrel 270 is sufficiently inserted into seating nipple 280, the weight of rod string 250 and/or additional downward force may be used to apply pressure to sealingly engage mating surfaces 249, 275. Once seating mandrel 270 is sufficiently seated within seating nipple 280, tubing string 260 is filled with fluid above tool 240 to pressure test tubing string 260. In particular, the fluid in tubing string 260 above stator 220 pushes ball 243 downward into sealing engagement with seat 246*c*, thereby restricting and/or preventing fluid above stator 220 from flowing axially down beyond stator 220. Then the fluid level or pressure in tubing string 260 between the surface and stator 220 is measured to assess whether there are any leaks in the tubing string 260 above stator 220, and to assess the static seal between seal element 274 and seating nipple 280. If the fluid pressure and/or level drops, there is likely a leak in tubing string 260 between the surface and stator 220, and/or a leak between seal element 274 and seating mandrel 270.

Figure 14:
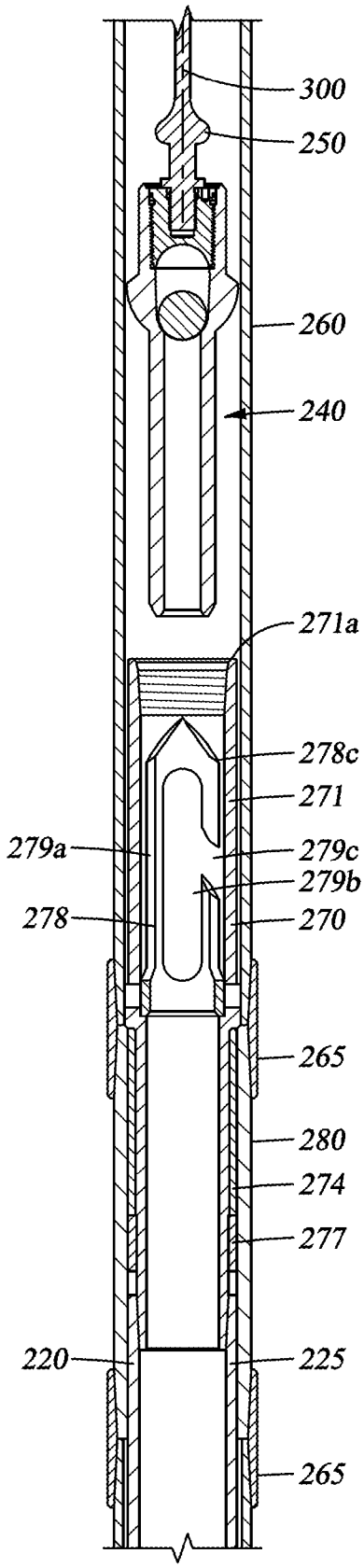
FIG. 14 is a cross-sectional view of the delivery/retrieval tool of FIG. 8 being removed to the surface after pressure testing the tubing string and seal between the tubing string and the stator of FIGS. 5 and 8.

Referring now to FIGS. 5, 8, and 11, to initiate downhole pumping operations, rod string 250 is threaded into lift seal adaptor 244 of tool 240, and stator 220 is hung from tool 240 via engagement of pin 245 and J-latch member 278. Stator 220 is then lowered into tubing string 260 with rod string 250 (FIG. 8). When stator 220 comes into contact with the reservoir fluid in tubing string 260, the reservoir fluid is permitted to flow axially across stator 220 through the inside of stator 220, lower and upper sections 246*b*, a of cavity 246, and bypass port 247. Once seating mandrel 270 is sufficiently seated in seating nipple 280 the entire tubing string 260 is filled with fluid to pressure test tubing string 260 and the static seal between seal element 274 and seating nipple 280. Once it is determined that tubing string 260 and seal element 274 will hole pressure, tool 240 is decoupled from stator 220 by lowering rod string 250 and tool 240 while applying rotation on rod sting 270 to move pin 245 from engagement slot 279*b* through circumferential slot 279*c* to access slot 279*a*. Once pin 245 is disposed in access slot 279*a*, rod string 250 and tool 240 may be pulled axially upward from J-latch member 278 and stator 220 to the surface as shown in FIG. 14.

At the surface, tool 240 is removed from the lower end of rod string 250, and rotor 230 is connected to the lower end of rod string 250. As this embodiment does not include a no-go device on rotor 230, rotor 230 may comprise a conventional rotor. Rotor 230 is then axially lowered into tubing string 260 and advanced into stator liner 221 until rotor 230 hits a tag-bar pin disposed below stator 220. Rotor 230 is then pulled up a predetermined distance to ensure that rotor 230 is properly positioned in stator 220. With rotor 230 properly positioned, rod string 250 and rotor 230 may be rotated by a drivehead at the surface to begin pumping operations.

On some conventional insertable progressive cavity pump designs, when flushing the well is necessary, extra care must me taken. In particular, the rotor must only be lifted high enough to free it from the stator, but not so high as to engage the no-go assembly and pull the stator from the seating nipple, thereby breaking any seal formed therebetween. Further, to pull the rotor sufficiently to enable flushing, a flushing tube must be installed to the upper end of the stator prior to installing the system to ensure that there is sufficient room of the rotor to be pulled free of the stator with out pulling the seating mandrel free.

In addition, on some conventional insertable progressive cavity pumps, no means of pressure testing the tubing string or the seal between the stator and the tubing string is provided. In particular, on many conventional insertable PC pump designs, once the seating mandrel is inserted into the seating nipple, there is no way of pulling the rod sting out of the tubing string to insert a pressure testing device without dislodging the stator. Still further, on many previous insertable progressing cavity pump designs a standard rotor and stator could not be used because a special no-go assembly is required to deliver and retrieve the pump assembly.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A progressive cavity pump system comprising:

a tubing string disposed within a borehole, the tubing string having a longitudinal axis and including a seating nipple disposed at a predetermined depth in the tubing string;

a stator positioned within the tubing string, wherein the stator includes a radially outer housing having an upper end and a lower end, a radially inner liner having a helical-shaped inner surface, and a seating mandrel coupled to the upper end of the housing;

a seal element disposed about the seating mandrel, wherein the seal element forms a static seal with the inner surface of the seating nipple;

a delivery/retrieval tool coupled to a lower end of a rod string, wherein an upper end of the seating mandrel of the stator includes a coupling member adapted to releasably couple to the delivery/retrieval tool; and wherein the delivery/retrieval tool has a first position in the tubing string coupled to the seating mandrel of the stator and a second position in the tubing string separated from and axially spaced above the seating mandrel.

2. The pump system of claim 1 wherein the coupling member is a J-latch member including an axial access slot extending to the upper end of the coupling member, an axial engagement slot, and a generally circumferential slot extending between the access slot and the engagement slot; and wherein the delivery/retrieval tool includes a pin extending radially from the outer surface of the delivery/retrieval tool, the pin adapted to releasably engage the engagement slot of the J-latch member.

3. The pump system of claim 1 wherein the stator is hung from delivery/retrieval tool in the first position.

4. A progressive cavity pump system comprising:

a tubing string disposed within a borehole, the tubing string including a seating nipple disposed at a predetermined depth in the tubing string;

a stator positioned within the tubing string, wherein the stator includes a radially outer housing having an upper end and a lower end, a radially inner liner having a helical-shaped inner surface, a seating mandrel coupled to the upper end of the housing;

a seal element disposed about the seating mandrel, wherein the seal element forms a static seal with the inner surface of the seating nipple;

a delivery/retrieval tool coupled to the lower end of a rod string, and wherein the seating mandrel includes a coupling member at its upper end releasably coupled to the delivery/retrieval tool;

wherein the delivery/retrieval tool further comprises:

a body;

an inner cavity within the body, wherein the inner cavity includes an upper section having a first diameter and a lower section extending from the upper section through the lower end of the body, wherein the lower section has a second diameter that is less than the first diameter;

wherein the upper section and lower section intersect to form an annular seat;

a plug disposed within the upper section and adapted to sealingly engage the annular seat; and a bypass port extending from the upper section to the outer surface of the body.

5. The pump system of claim 4 wherein the delivery/retrieval tool includes a tapered outer surface that forms an annular static seal with the upper end of the seating mandrel.

6. A progressive cavity pump system comprising:

a tubing string disposed within a borehole, the tubing string including a seating nipple disposed at a predetermined depth in the tubing string;

a stator positioned within the tubing string, wherein the stator includes a radially outer housing having an upper end and a lower end, a radially inner liner having a helical-shaped inner surface, and a seating mandrel coupled to the upper end of the housing;

a seal element disposed about the seating mandrel, wherein the seal element forms a static seal with the inner surface of the seating nipple;

a rotor axially positioned in the liner, wherein the rotor has a helical-shaped outer surface and is coupled to the lower end of a rod string;

wherein the rotor has a first position in the tubing string disposed within the housing and a second position in the tubing string removed from the stator and axially spaced above the seating mandrel.

7. The pump system of claim 6 wherein the maximum outer diameter of the rotor and the rod string is less than the minimum inner diameter of the housing.

8. A method of pumping fluid from a well to the surface comprising:

(a) coupling a delivery/retrieval tool to a lower end of a rod string;

(b) coupling an upper end of a stator to the delivery/retrieval tool;

(c) lowering the stator into a tubing string disposed in a borehole with the rod string and the delivery/retrieval tool;

(d) positioning the stator at a predetermined depth in the tubing string;

(e) pressure testing the tubing string with the delivery/retrieval tool; and (f) lowering a rotor into the tubing string after (e).

9. The method of claim 8 further comprising:

coupling a seating nipple to the tubing string; and positioning the seating nipple at the predetermined depth.

10. The method of claim 9 wherein the stator comprises:

a housing with an upper end and a lower end;

a liner disposed in the housing and having a helical-shaped inner surface;

a seating mandrel coupled to the upper end of the housing; and a seal element disposed about the seating mandrel.

11. The method of claim 10 further comprising:

forming a static seal between the seating mandrel and the seating nipple with the seal element; and pressure testing the static seal with the delivery/retrieval tool.

12. The method of claim 11 wherein pressure testing the tubing string and pressure testing the static seal further comprise:

filling the tubing string with a fluid above the static seal;

applying a constant pressure to the fluid or measuring the height of the fluid from the static seal; and checking for changes in the pressure applied to the fluid or checking for changes in the height of the fluid from the static seal.

13. The method of claim 12 wherein the delivery/retrieval tool comprises:

a body having an outer surface;

an inner cavity within the body, wherein the inner cavity includes an upper section having a first diameter and a lower section extending from the upper section through the lower end of the body, wherein the lower section has a second diameter that is less than the first diameter;

wherein the upper section and lower section intersect to form an annular seat;

a plug disposed within the upper section and adapted to sealingly engage the annular seat;

a bypass port extending from the upper section to the outer surface of the body.

14. The method of claim 13 further comprising:

forming a seal between the plug and the annular seat;

forming a seal between the outer surface of the body and the upper end of the seating mandrel.

15. The method of claim 10 wherein the upper end of the seating mandrel comprises a J-latch;

wherein the outer surface of the delivery/retrieval tool includes a pin extending radially outward; and wherein (b) comprises engaging the pin and the J-latch.

16. The method of claim 8 further comprising:

(g) decoupling the delivery/retrieval tool from the upper end of the stator;

(h) removing the delivery/retrieval tool from the rod string;

(i) coupling the rotor to the lower end of the rod string; and (j) inserting the rotor into the stator.

17. The method of claim 16 wherein (g)-(i) occur after (a)-(e).

18. A method of pumping fluid from a well to the surface comprising:

(a) inserting a stator into a tubing string disposed in a borehole;

(b) delivering the stator to a predetermined depth within the tubing string;

(c) inserting a rotor into the tubing string disposed in the borehole after (b);

(d) lowering the rotor downhole through the tubing string to the stator after (c);

(e) inserting the rotor into the stator; and (f) rotating the rotor relative to the stator.

wherein the stator is coupled to the rod string with a delivery/retrieval tool comprising:

a body having an outer surface;

an inner cavity within the body, wherein the inner cavity includes an upper section having a first diameter and a lower section extending from the upper section through the lower end of the body, wherein the lower section has a second diameter that is less than the first diameter;

wherein the upper section and lower section intersect to form an annular seat;

a plug disposed within the upper section and adapted to sealingly engage the annular seat;

a bypass port extending from the upper section to the outer surface of the body.

19. The method of claim 18 wherein the stator comprises:

a seating mandrel with an outer surface having an annular shoulder; and a seal element disposed about the seating mandrel.

20. The method of claim 19 further comprising:

engaging a seating nipple in the tubing string with the annular shoulder of the stator;

engaging the seating nipple with the seal element; and forming a static seal between the seal element and the seating nipple.

21. The method of claim 18 wherein (b) further comprises allowing fluid in the tubing string to flow axially upward through the stator, the inner cavity of the delivery/retrieval tool, and the bypass port.

* * * * *